United States Patent [19]

Hobart et al.

[11] 3,995,999

[45] Dec. 7, 1976

[54] PROCESS OF IMPARTING CREASABILITY OF CELLULOSIC AND OTHER HYDROXY-CONTAINING POLYMERIC FIBERS AND FABRICS BY REACTION OF N-METHYLOL DERIVATIVES IN THE PRESENCE OF PHOSPHORYLATING AGENTS AND PRODUCTS

[75] Inventors: Stanley R. Hobart, New Orleans; Charls H. Mack, Covington; Stanley P. Rowland, New Orleans, all of La.

[73] Assignee: The United States of America as represented by the Secretary of Agriculture, Washington, D.C.

[22] Filed: July 10, 1975

[21] Appl. No.: 594,898

Related U.S. Application Data

[63] Continuation-in-part of Ser. No. 399,013, Sept. 20, 1973, abandoned.

[52] U.S. Cl. ..... 8/116 P; 8/185

[51] Int. Cl.[2] ..... D08M 13/34

[58] Field of Search ..... 8/116 P, 185

[56] References Cited

UNITED STATES PATENTS 2,957,746 10/1960 Buck et al. ..... 8/185

OTHER PUBLICATIONS

Marsh, J. T., *Crease Resisting Fabrics*, Reinhold Publ. Corp., N.Y., 1962, p. 75.

*Primary Examiner*—Paul R. Michl
*Attorney, Agent, or Firm*—M. Howard Silverstein; David G. McConnell; Salvador J. Cangemi

[57] ABSTRACT

Creasability properties are imparted to cotton cellulosic and other hydroxy-containing polymeric fabrics and fibers by reacting them with N-methylol derivatives in the presence of phosphorylating agents. The resulting fabrics are both heat creasable and crease resistant.

16 Claims, No Drawings

PROCESS OF IMPARTING CREASABILITY OF CELLULOSIC AND OTHER HYDROXY-CONTAINING POLYMERIC FIBERS AND FABRICS BY REACTION OF N-METHYLOL DERIVATIVES IN THE PRESENCE OF PHOSPHORYLATING AGENTS AND PRODUCTS

This is a continuation-in-part of Serial No. 399,013 filed September 20, 1973 now abandoned.

The present invention relates to a process for the preparation of new and useful fibers and fabrics to be employed in the textile field. More specifically, this invention relates to the crosslinking of cellulosic and the like materials with N-methylol derivatives in the presence of phosphorylating agents, and to the products produced in the reactions. In the case of cotton, a chemical treatment of this nature would be carried out by conventional wet-process techniques and with no special modification of equipment to yield fabrics with resiliency and possessing the additional character that the existing crosslinks can be broken and reformed by the application of heat, in this manner providing an excellent additional durable property to cotton textiles.

Di- or polyfunctional N-methylol compounds are well known in the textile field to react in the presence of acidic catalysts with cotton cellulose and other polyhydroxy fibers resulting in a textile possessing resiliency, easy care and permanent press features. This resilience is highly desirable in that the fabric is resistant to wrinkling during wear or norman laundering processes. However, when it is desired, for aesthetic or other reasons, to impart a crease to the substrate, the wrinkle resistance is objectionable. Similarly, if a crease is present at the time of the crosslinking reaction, the crease is resistant to removal. In other words, the properties of crease resistance and creasability seem to be mutually exclusive. The crosslinks which tend to hold the fabric in a flat configuration likewise tend to prevent creasing.

To overcome these deficiencies it has been suggested that the acidic catalyst is retained in the textile so as to catalyze, when desired, the breaking and reforming of the crosslinks in the new and creased configuration. In 1958 Reid et al. in vol. 28, pg. 242 of Textile Research Journal reviewed the field of the application of durable creases into wrinkle resistant cotton. In addition, Buck and Getchell in U.S. Pat. No. 2,957,746, issued Oct. 25, 1960, invented a process for introducing a durable crease into creaseproofed cellulose by treating it with an acid catalyst and hot pressing a crease in the treated area. Unfortunately, the acid catalyst is normally present in excess and in the presence of heat causes severe degradation of the cellulosic material. Additionally, the catalysts normally used are readily removed by either washings or evaporation. More recently, it has been suggested that acidic functions are to be incorporated into the crosslinking resin matrix either by co-polymerization or co-reaction. In most of these cases the acidic polymer or co-reactant dilutes the effectiveness of the crosslinking system.

It is the object of this invention to provide a new and improved method for producing a wrinkle resistant fabric which contains an acidic creasing catalyst that does not evaporate, wash out, dilute the effectiveness of the crosslinking system, or induce any undersirable side effect that would impair the fabric's utility.

This objective is achieved by phosphorylating the N-methylolated cotton cellulose and thereby attaching the acidic catalyst directly to the cellulose via a chemical bond. The resulting acidic phosphoryl groups, $$\text{Cell}-\text{O}-\overset{\overset{\text{O}}{\|}}{\text{P}}(\text{OH})_2$$

are thus favorably placed on the cellulosic chain in an optimum position to catalyze the following reversible reaction:

$$\text{Cell OCH}_2\text{N}-\text{X}-\text{NCH}_2\text{OCell}' + \text{Cell}'' \text{ OH} \rightleftharpoons \text{Cell OP}(\overset{\overset{\text{O}}{\|}}{\text{O}})(\text{OH})_2 + \text{Cell OCH}_2\text{N}-\text{X}-\text{NCH}_2\text{OCell}'' + \text{Cell}'\text{OH}$$

where Cell, Cell′, and Cell″ represent different points of attachment along the cellulose chain and X, any grouping of atoms normally found in conventional durable press reagents of the N-methylol type. An advantage of the products prepared by process of this invention is that the acidic groups established therein will not wash out during conventional laundering nor will they be removed by evaporation during ironing or tumble drying.

A further advantage of the process of this invention is the ability to N-methylolate and phosphorylate the cotton cellulose simultaneously utilizing the phosphorylating agent as the catalyst for the N-methylolation reaction. In this manner the conventional acid catalyst normally used with the N-methylol derivatives may be eliminated from the procedure.

A still further advantage of the process of this invention is the ability to first phosphorylate the cotton cellulose and then, in a second step, to N-methylolate the substrate using the acid form of the phosphoryl group as the catalyst for the second reaction. In this procedure the need for an additional acid catalyst, which is normally used in cellulose crosslinking, is eliminated. An additional benefit may be derived from this sequence since the fixed catalyst defines the site on the cellulose for the crosslink formation and is thereby strategically positioned and readily available for crosslink breaking and reformation.

An added feature of this invention, by nature of the phosphorylation reaction, the finished textile possesses nonsoiling qualities and shows rapid cation exchange with some transition metal salts.

The chemically-modified cotton celluloses and other hydroxy-containing substrates which we produced by the process of this invention were submitted to chemical and physical tests for proper evaluation. The wrinkle recovery tests employed were carried out according to ASTM Method D1295-53T, the tensile and elongation tests according to ASTM Method D39-59, and the crease evaluation test according to AATCC Test Method 88C-1969. In testing the chemically modified derivatives prepared by the process of this invention, the chromotropic acid colorimetric test was used to analyze for combined formaldehyde. X-ray fluorescence was used to analyze for combined phosphorus and the Kjeldahl method to analyze for combined nitrogen.

The textiles prepared by the process of this invention possessed relatively high conditioned wrinkle recovery angles and also possessed the ability to be creased merely by ironing with a hot iron or by heating in an oven for a short time in a folded configuration. The creases thus produced were found to be durable to multiple launderings and tumble dryings without excessive reduction in crease rating.

The wrinkle resistant, yet creasable, textiles produced by the process of this invention are prepared as follows. The scoured and bleached cotton fabric, fiber, or other hydroxy-containing substrate is impregnated with the reagents comprising a mixture of the N-methylol crosslinking derivative and the phosphorylating agent. The excess solution is removed, the material dried, and cured. The dried and cured material is then wetted with an aqueous solution containing an acidic reagent. Finally, the acidified material is rinsed with deionized water until the wash liquors are completely free of acidity. The N-methylol crosslinking reagent can be about 5% to 15% by weight and the phosphorylating reagent can be about 1% to 10% by weight of the solution. The pH of the solution can be about from 1.0 to 6.4, the lower pH values yielded higher phosphorus content in the finished material but a weaker finished fabric and a lower wrinkle recovery is obtained in this manner. The wet impregnation of solution (wet pickup) ranged from about 90% to 128%. Once the fabric has been impregnated to the proper wet pickup, it is generally dried for about 2 to 10 minutes at about 50° C to 120° C and cured for about 2 to 10 minutes at about 140° to 170° C. The acidic soaking reagent can be about from 1% to 5% by weight and the pH of the final rinse solution can be about pH 7.0.

The fabrics treated by this process which have been determined as acceptable are those which have been phosphorylated to about 0.4% to 1.0% combined phosphorus and resin treated to about 4% to 11% resin content.

The preferred degree of chemical modification by the process of this invention is one which yields a product with at least about 7% crosslinking resin add-on and at least about 0.6% combined phosphorus. The fabrics treated by the process of this invention which possess the preffered levels of chemical modification will possess a wrinkle recovery of about 280° (2 X Warp), and a breaking strength retention of about 60% that of the original. When this fabric is creased with a hot iron at the "cotton" setting (temperature about 200° C) for about 30 seconds, a crease rating of 5, i.e., the highest rating, will be obtained and the crease rating of 5 will be maintained through at least five machine washings and tumble dryings.

The chemical reagents useful in carrying out the process of this invention are as follows: crosslinking reagents — dimethyloldihydroxyethylene urea and dimethylolethylene urea; phosphorylating reagents — sodium dihydrogen orthophosphate, ammonium dihydrogen or orthophosphate, sodium hexametaphosphate, and orthophosphoric acid; acidifying reagents — orthophosphoric acid, sodium dihydrogen orthophosphate monohydrate, and acetic acid. The hydroxyl-containing fabrics or fibers useful in carrying out this process are native cotton cellulose, native cotton cellulose-synthetic blend, regenerated cellulose-synthetic blend, and partially chemically-modified native or regenerated cellulose.

With reference to the cellulosic and other material to which this invention applies, it must be pointed out that cotton cellulose in fabric, yarn, or any other form has responded favorably as a substrate. Furthermore, the process is applicable likewise to wood fibers, ramie, rayon, polyvinyl alcohol in various forms, and to other polymers which contain an abundance of hydroxylic groups.

The following examples are provided to illustrate the preferred embodiments of this invention and are not meant to be a limit in any manner to the spirit of the invention.

EXAMPLE 1

A cotton printcloth fabric was passed into an aqueous solution containing 10% (wt./wt.) dimethyloldihydroxyethyleneurea (DMDHEU), 5% sodium dihydrogen orthophosphate monohydrate, and 0.1% non-ionic wetting agent, the solution having a ph of 4.5. The excess solution was squeezed off, and the process repeated to ensure thorough impregnation. The fabric was dried at 60° C for seven minutes and cured at 140° C for 8 minutes. It was washed in hot water and air-dried. The treated fabric had a weight add-on of 8.7% and contained 1.39% nitrogen, 2.03% formaldehyde, and 0.44% phosphorus. The warp conditioned wrinkle recovery angle was 131°, and 66% of the original warp strip breaking strength was retained. The untreated fabric had a warp conditioned wrinkle recovery angle of 91°.

A portion of this fabric was soaked in 1% orthophosphoric acid solution, rinsed, with de-ionized water until the rinse solution was free of acidity, and creased by heating between glass plates, which were held together with a clip, a 160° C for 6 minutes. The AATCC crease rating was 5 (maximum rating [best] on a scale of 0–5) both before and after five machine washings and dryings (home launderings). When the untreated fabric was creased in the same manner, its crease ratings were 5 before and 1.5 after five home launderings. In addition, a fabric having a 6.6% weight add-on of DMDHEU applied in the presence of the conventional Lewis acid catalyst, zinc nitrate hexahydrate, and creased in the same manner had a crease rating of 5 before and 1.5 after five home launderings.

EXAMPLE 2

Cotton fabrics were impregnated as in Example 1 except that the sodium dihydrogen orthophosphate monohydrate concentration and the curing time and temperatures were varied. The effects of these variations on the weight add-ons, warp conditioned wrinkle recoveries, warp strip breaking strengths, and the ratings of creases which were introduced in the same manner as described in Example 1 and given five home launderings are shown in Table I.

TABLE I

| Molar ratio, DMDHEU: $NaH_2PO_4 \cdot H_2O$ | $NaH_2PO_4 \cdot H_2O$ conc. % | pH | Curing Temp. °C. | Curing Time min. | Weight add-on % | Wrinkle recovery cond. W | Breaking strength strip warp % ret. | Crease rating after 5 laund. |
|---|---|---|---|---|---|---|---|---|
| 1:0.3 | 2.3 | 6.2 | 160 | 3 | 4.3 | 100 | 74 | 4.5 |
| 1:0.4 | 3.0 | 6.2 | 160 | 3 | 5.4 | 115 | 71 | 4.5 |

TABLE I-continued

| Molar ratio, DMDHEU: $NaH_2PO_4 \cdot H_2O$ | $NaH_2PO_4 \cdot H_2O$ conc. % | pH | Curing Temp. °C. | Curing Time min. | Weight add-on % | Wrinkle recovery cond. W | Breaking strength strip warp % ret. | Crease rating after 5 laund. |
|---|---|---|---|---|---|---|---|---|
| 1:0.5 | 3.9 | 6.2 | 160 | 3 | 8.1 | 126 | 63 | 5 |
| 1:0.6 | 4.6 | 6.2 | 160 | 3 | 9.1 | 128 | 59 | 5 |
| 1:0.6 | 4.6 | 6.4 | 140 | 3 | 7.0 | 124 | 71 | 4.5 |
| 1:0.6 | 4.6 | 6.4 | 140 | 4 | 7.7 | 130 | 66 | 4.5 |
| 1:0.6 | 4.6 | 6.4 | 140 | 5 | 8.4 | 136 | 68 | 5 |
| 1:0.6 | 4.6 | 6.4 | 140 | 6 | 9.0 | 137 | 62 | 4.5 |
| 1:0.6 | 4.6 | 6.4 | 150 | 2 | 6.5 | 128 | 67 | 5 |
| 1:0.6 | 4.6 | 6.4 | 150 | 3 | 6.7 | 131 | 65 | 5 |
| 1:0.6 | 4.6 | 6.4 | 150 | 4 | 8.1 | 136 | 58 | 5 |
| 1:0.6 | 4.6 | 6.4 | 150 | 5 | 8.9 | 137 | 63 | 5 |
| 1:0.6 | 4.6 | 6.4 | 160 | 2 | 9.6 | 135 | 62 | 5 |
| 1:0.6 | 4.6 | 6.4 | 160 | 2.5 | 9.3 | 135 | 60 | 5 |
| 1:0.6 | 4.6 | 6.4 | 160 | 3 | 10.1 | 139 | 58 | 5 |
| 1:0.6 | 4.6 | 6.4 | 160 | 3.5 | 10.6 | 140 | 61 | 5 |

EXAMPLE 3

A cotton fabric was impregnated as in Example 1 except that 2.9% (wt./wt.) sodium hexametaphosphate was used in place of sodium dihydrogen orthophosphate monohydrate and the pH was adjusted to 4 by the addition of orthophosphoric acid (about 1% was required). The fabric weight add-on was 8.6%, the warp conditioned wrinkle recovery was 133°, and 63% of the original warp strip breaking strength was retained. The fabric was creased as in Example 1 and the crease was rated 5 both before and after five home laundering cycles.

EXAMPLE 4

Cotton fabrics were impregnated as in Example 3 except that the solution pH was varied (by addition of small amounts of orthophosphoric acid), and the sodium hexametaphosphate concentration and the curing time and temperature were also varied. The effects of these variations on the weight add-on, warp conditioned wrinkle recovery, warp strip breaking strength, and ratings of creases introduced as in Example 1 after five home launderings are shwon in Table II.

TABLE II

| Molar ratio: DMDHEU: $(NaPO_3)_6$ | $(NaPO_3)_6$ conc. % | pH | Curing Temp. °C | Curing Time min. | Weight add-on % | Wrinkle recovery cond. W | Br. str. strip warp, % ret. | Crease rating after 5 laund. |
|---|---|---|---|---|---|---|---|---|
| 1:1 | 5.7 | 5.5 | 160 | 3 | 5.5 | 101 | 80 | 4 |
| 1:1 | 5.7 | 5.0 | 160 | 3 | 6.1 | 127 | 75 | 5 |
| 1:1 | 5.7 | 4.5 | 160 | 3 | 9.3 | 128 | 69 | 5 |
| 1:1 | 5.7 | 4.0 | 160 | 3 | 10.0 | 134 | 59 | 5 |
| 1:0.25 | 1.4 | 3.5 | 160 | 3 | 8.1 | 128 | 57 | 5 |
| 1:0.5 | 2.9 | 4.0 | 160 | 3 | 8.6 | 133 | 63 | 5 |
| 1:0.75 | 4.3 | 4.0 | 160 | 3 | 8.6 | 131 | 51 | 5 |
| 1:1 | 5.7 | 4.0 | 160 | 3 | 9.7 | 135 | 57 | 5 |
| 1:0.5 | 2.9 | 4.5 | 140 | 5 | 7.5 | 113 | 68 | 5 |
| 1:0.5 | 2.9 | 4.5 | 140 | 6 | 7.9 | 126 | 63 | 5 |
| 1:0.5 | 2.9 | 4.5 | 140 | 7 | 8.2 | 120 | 59 | 5 |
| 1:0.5 | 2.9 | 4.5 | 140 | 8 | 8.6 | 128 | 63 | 5 |
| 1:0.5 | 2.9 | 4.5 | 150 | 3 | 8.1 | 120 | 70 | 5 |
| 1:0.5 | 2.9 | 4.5 | 150 | 4 | 9.0 | 123 | 61 | 5 |
| 1:0.5 | 2.9 | 4.5 | 150 | 5 | 9.6 | 129 | 63 | 5 |
| 1:0.5 | 2.9 | 4.5 | 150 | 6 | 9.3 | 132 | 63 | 5 |
| 1:0.5 | 2.9 | 4.5 | 160 | 2 | 7.7 | 126 | 59 | 5 |
| 1:0.5 | 2.9 | 4.5 | 160 | 2.5 | 8.2 | 131 | 57 | 5 |
| 1:0.5 | 2.9 | 4.5 | 160 | 3 | 8.7 | 132 | 44 | 5 |
| 1:0.5 | 2.9 | 4.5 | 160 | 3.5 | 9.1 | 130 | 66 | 5 |

EXAMPLE 5

A cotton fabric was impregnated as in Example 1 except that the solution contained 1% orthophosphoric acid in place of the sodium dihydrogen orthophosphate monohydrate, the pH was 1, and the curing was at 160° C for 3 minutes. A 7.6% weight add-on resulted and the fabric had a warp conditioned wrinkle recovery angle of 139° and 48% of the original warp strip breaking strength retained. The AATCC crease rating of a sample which had been creased as in Example 1 was 5 before and 4.5 after five home launderings.

EXAMPLE 6

A cotton fabric was impregnated, dried, cured, and washed as in Example 1 with a solution containing 12% (wt./wt.) dimethylolethyleneurea (DMEU), 1% zinc nitrate hexahydrate, and approximately 0.1% of a nonionic wetting agent. This sample had a weight add-on of 7.9% and a warp conditioned wrinkle recovery angle of 137°.

A portion of this fabric was twice impregnated with a 25% (wt./wt.) aqueous solution of ammonium dihydrogen orthophosphate and squeezed free of excess solution, heated at 160° C for 8 minutes, washed in hot water, and air-dried. This sample had a warp conditioned wrinkle recovery of 126°.

These two samples were impregnated with a 5% (wt./wt.) solution of sodium dihydrogen orthphosphate monohydrate, rinsed free of excess, and creased as in Example 1. The sample treated with DMEU and ammonium dihydrogen orthophosphate had a crease rating of 3.8 while that treated with DMEU only had a rating of 3.1.

The improvement in creasability demonstrates the catalysis of breaking and reforming DMEU crosslinks by the phosphoryl groups introduced in the ammonium dihydrogen orthophosphate treatment.

EXAMPLE 7

A cotton fabric was twice impregnated with a 20% aqueous solution of sodium hexametaphosphate and squeezed free of excess solution. The fabric was heated at 160° C for 8 minutes, washed in hot water, and air-dried. The fabric had a 5.6% weight add-on.

A portion of this fabric was impregnated with 1% hydrochloric acid solution, rinsed free of excess acid, and air-dried. It was twice impregnated with a solution of 10% dimethylolethyleneurea (DMEU) and 0.1% non-ionic wetting agent and squeezed free of excess solution. It was dried at 60° C for 7 minutes, cured at 160° for 5 minutes, washed in hot water, and air-dried. This sample had a 4.8% DMEU weight add-on.

The fabric was creased as in Example 1 except that 5% acetic acid was used for soaking instead of 1% orthophosphoric acid. The AATCC crease rating was 5 before and 2.5 after five home launderings. A cotton fabric having a 9.5% weight add-on of DMEU only was creased in the same manner and crease rated 4 before and 1 after laundering.

EXAMPLE 8

A diethylaminoethyl (DEAE) cotton fabric containing 0.8% nitrogen was treated with sodium hexametaphosphate as in Example 7 and had a 2.5% weight add-on. A portion of this fabric was soaked in 1% hydrochloric acid, rinsed free of excess, and dried. It was impregnated with DMEU, dried, cured, washed, and air-dried as in Example 7. The DMEU weight add-on was 5.2% and the warp conditioned wrinkle recovery angle was 146°. The fabric was creased as in Example 7 and had a crease rating of 5 before and 3.5 after five home launderings.

EXAMPLE 9

A diethylaminoethyl (DEAE) cotton fabric containing 0.8% nitrogen was impregnated with a 2% hydrochloric acid solution, rinsed free of excess, and air-dried. The dry fabric was impregnated with dimethylolethyleneurea (DMEU), dried, cured, washed, and air-dried as in Example 7. The weight add-on was 3.7%.

The fabric was immersed in 2% ammonium hydroxide, rinsed well and subsequently immersed in 5% ammonium dihydrogen orthophosphate. The excess ammonium dihydrogen orthophosphate was removed by rinsing with three changes of de-ionized water and the fabric was creased between glass plates and heated as in Example 1. The DMEU crosslinked and phosphorylated fabric had a crease rating of 5 before and 4 after five home launderings.

The creased and laundered fabric was impregnated with a solution of 5% sodium dihydrogen orthophosphate monohydrate, washed and blotted free of excess solution, and ironed flat with a home iron at the cotton setting (180°–210° C) for 30 seconds. The crease rating was then 1. This demonstrates the crosslink reversibility in the presence of the phosphoryl groups.

EXAMPLE 10

A diethylaminoethyl (DEAE) cotton fabric containing 0.8% nitrogen was impregnated with hydrochloric acid, treated with DMEU, and phosphorylated as in Example 9 except that diammonium hydrogen orthophosphate was used in place of ammonium dihydrogen orthophosphate. This fabric had a crease rating of 5 before and 2.5 after five home launderings.

The fabric was impregnated in sodium dihydrogen orthophorphate monohydrate solution and ironed flat as in Example 9. The crease rating was 1.

EXAMPLE 11

A diethylaminoethyl (DEAE) cotton fabric containing 1.2% nitrogen was immersed in 1% hydrochloric acid, rinsed free of excess with de-ionized water, and dried. It was twice impregnated with a 15% aqueous solution of dimethylolethyleneurea (DMEU) and the excess squeezed off. The fabric was dried at 80° C for 3 minutes, cured at 160° C for 3 minutes, washed in hot water, and air-dried. The weight add-on was 8.7%, the nitrogen content was 4.02%, and the warp conditioned wrinkle recovery angle was 153°.

The fabric was impregnated with a solution of 5% sodium dihydrogen orthophosphate monohydrate, rinsed with three changes of de-ionized water, and blotted free of excess liquid. The fabric was creased as in Example 1. The crease rating was 5 before and 4.5 after five home launderings.

The fabric was impregnated in sodium dihydrogen orthophosphate monohydrate solution and ironed flat as in Example 9. The crease rating was 1 which demonstrates the breaking and reforming of DMEU crosslinks in the presence of phosphoryl groups.

We claim:

1. A process for preparing a wrinkle resistant cellulosic textile material with inherent, optional, post-treatment creasing capability which process consists of the following stepwise operations:

a. impregnating a cellulosic textile material with an aqueous solution of pH 1.0 to 6.4 containing about from 5% to 15% of dimethyloldihydroxyethylene urea and about from 1% to 10% of a phosphorylating agent selected from the group consisting of sodium dihydrogen orthophosphate, ammonium dihydrogen orthophosphate, sodium hexametaphosphate, and orthophosphoric acid;

b. removing the excess impregnating solution to a wet pickup of about from 80% to 130%;

c. drying the impregnated cellulosic textile material for about from 2 minutes to 10 minutes at a temperature of about from 50° C to 120° C, using the shorter periods of time with the higher temperatures;

d. curing the dried cellulosic textile material from (c) for about from 2 minutes to 10 minutes at a temperature of about from 140° C to 170° C, using the shorter periods of time with the higher temperatures;

e. soaking the dried cellulosic material from (d) in an aqueous solution containing about from 1% to 5% of an acidifying reagent selected from the group consisting of orthophosphoric acid, sodium dihydrogen orthophosphate monohydrate and acetic acid until the material is completely wetted;

f. rinsing the acid solution soaked cellulosic textile material from (e) with de-ionized water until the spent rinse water tests free of acidity and finally drying the water rinsed cellulosic textile material to produce a wrinkle resistant, chemically modified cellulosic textile material with optional creasing capability.

2. The process of claim 1 wherein the phosphorylating agent is sodium dihydrogen orthophosphate.

3. The process of claim 1 wherein the phosphorylating agent is ammonium dihydrogen orthophosphate.

4. A process for preparing a wrinkle resistant cellulosic textile material with inherent, optional, post-treatment creasing capability which process consists of the following stepwise operations:

a. impregnating a cellulosic textile material with an aqueous solution of pH 1.0 to 6.4 containing about from 5% to 15% of dimethyloldihydroxyethylene urea and about from 1% to 10% sodium hexametaphosphate;

b. removing the excess impregnating solution to a wet pickup of about from 80% to 130%;

c. drying the impregnated cellulosic textile material for about from 2 minutes to 10 minutes at a temperature of about from 50° C to 120° C, using the shorter periods of time with the higher temperatures;

d. curing the dried cellulosic textile material from (c) for about from 2 minutes to 10 minutes at a temperature of about from 140° C to 170° C, using the shorter periods of time with the higher temperatures;

e. soaking the dried cellulosic material from (d) in an aqueous solution containing about from 1% to 5% of an acidifying reagent selected from the group consisting of orthophosphoric acid, sodium dihydrogen orthophosphate monohydrate and acetic acid until the material is completely wetted; and f. rinsing the acid solution soaked cellulosic textile material from (e) with de-ionized water until the spent rinse water tests free of acidity and finally drying the water rinsed cellulosic textile material to produced a wrinkle resistant, chemically modified cellulosic textile material with optional creasing capability.

5. The process of claim 1 wherein the phosphorylating agent is orthophosphoric acid.

6. The process of claim 1 wherein the acidifying reagent is orthophosphoric acid.

7. The process of claim 1 wherein the acidifying reagent is sodium dihydrogen orthophosphate monohydrate.

8. The process of claim 1 wherein the acidifying reagent is acetic acid.

9. A process for preparing a wrinkle resistant cellulosic textile material with inherent, optional, post-treatment creasing capability which process consists of the following stepwise operations:

a. impregnating a cellulosic textile material with an aqueous solution of pH 1.0 to 6.4 containing about from 5% to 15% of dimethylolethylene urea and about from 1% to 10% of a phosphorylating reagent selected from the group consisting of sodium dihydrogen orthophosphate, sodium hexametaphosphate, and orthophosphoric acid;

b. removing the excess impregnating solution to a wet pickup of about from 80% to 130%;

c. drying the impregnated cellulosic textile material for about from 2 minutes to 10 minutes at a temperature of about from 50° C to 120° C, using the shorter periods of time with the higher temperatures;

d. curing the dried cellulosic textile material from (c) for about from 2 minutes to 10 minutes at a temperature of about from 140° C to 170° C, using the shorter periods of time with the high temperatures;

e. soaking the dried cellulosic textile material from (d) in an aqueous solution containing about from 1% to 5% of an acidifying reagent selected from the group consisting of orthophosphoric acid, sodium dihydrogen orthophosphate monohydrate and acetic acid until the material is completely wetted;

f. rinsing the acid solution soaked cellulosic textile material from (e) with de-ionized water until the spent rinse water tests free of acidity and finally drying the water rinsed cellulosic textile material to produce a wrinkle resistant, chemically modified cellulosic textile material with optional creasing capability.

10. The process of claim 9 wherein the phosphorylating agent is sodium dihydrogen orthophosphate.

11. The process of claim 9 wherein the phosphorylating agent is ammonium dihydrogen orthophosphate.

12. A process for preparing a wrinkle resistant cellulosic textile material with inherent, optional, post-treatment creasing capability which process consists of the following stepwise operations:

a. impregnating a cellulosic textile material with an aqueous solution of pH 1.0 to 6.4 containing about from 5% to 15% of dimethylolethylene urea and about from 1% to 10% of sodium hexametaphosphate phosphorylating reagent;

b. removing the excess impregnating solution to a wet pickup of about from 80% to 130%;

c. drying the impregnated cellulosic textile material for about from 2 minutes to 10 minutes at a temperature of about from 50° C to 120° C, using the shorter periods of time with the higher temperatures;

d. curing the dried cellulosic textile material from (c) for about from 2 minutes to 10 minutes at a temperature of about from 140° C to 170° C using the shorter periods of time with the high temperatures;

e. Soaking the dried cellulosic textile material from (d) in an aqueous solution containing about from 1% to 5% of an acidifiying reagent selected from the group consisting of orthophosphoric acid, sodium dihydrogen orthophosphate monohydrate and acetic acid until the material is completely wetted;

f. rinsing the acid solution soaked cellulosic textile material from (e) with de-ionized water until the agent rinse water tests free of acidity and finally drying the water rinsed cellulosic textile material to produce a wrinkel resistant, chemically modified cellulosic textile material with optional creasing capability.

13. The process of claim 9 wherein the phosphorylating agent is orthophosphoric acid.

14. The process of claim 9 wherein the acidifying reagent is orthophosphoric acid.

15. The process of claim 9 wherein the acidifying reagent is sodium dihydrogen orthophosphate monohydrate.

16. The process of claim 9 wherein the acidifying reagent is acetic acid.

* * * * *